US005197870A

United States Patent [19]

Yang

[11] Patent Number: 5,197,870

[45] Date of Patent: Mar. 30, 1993

[54] SAFETY LIGHTER

[76] Inventor: James C. H. Yang, 1425 W. 139th St., Gardena, Calif. 90249

[21] Appl. No.: 827,720

[22] Filed: Jan. 29, 1992

[51] Int. Cl.[5] ..... F23D 11/36

[52] U.S. Cl. ..... 431/153; 431/276

[58] Field of Search ..... 431/153, 254, 276, 277

[56] References Cited

U.S. PATENT DOCUMENTS

| | | | |
|---|---|---|---|
| 3,439,994 | 4/1969 | Cassan | 431/276 |
| 3,895,905 | 7/1975 | Nissen | 431/277 |
| 3,966,392 | 6/1976 | Lockwood | 431/277 |
| 4,784,602 | 11/1988 | Nitta | 431/277 |

FOREIGN PATENT DOCUMENTS

| | | | |
|---|---|---|---|
| 2264055 | 7/1973 | Fed. Rep. of Germany | 431/276 |

*Primary Examiner*—Carroll B. Dority

*Attorney, Agent, or Firm*—Jacobson, Price, Holman & Stern

[57] ABSTRACT

A gas lighter which operates by depressing an operating lever to lift a gas pipe thereby opening a gas release valve while a spark is generated by simultaneous rotation of a striker wheel in engagement with a flint has a safety mechanism for ensuring that the valve is closed when the operating lever is released. The safety mechanism includes a spring element which urges the operating lever out of engagement with the gas pipe in the released position.

8 Claims, 5 Drawing Sheets

SAFETY LIGHTER

BACKGROUND OF THE INVENTION

A traditional gas-fuel lighter is shown in FIG. 1. The lighter has an actuator lever 11 with a groove 111 at its forward end engaging the neck part 121 of gas pipe 12. When the plate 112 of lever 11 is pushed down, pins 113 on the lever rotate in apertures 171, 181 on a pair of supports 17, 18 on the top of the lighter body 16. This operation will make the groove 111 move upwards and lift the gas pipe 12 up so that a valve which is located beneath the gas pipe 12 will also be opened and spray gas out from the lighter. Meanwhile, a spark will be generated through mutual friction of a striker wheel 13 and a flint 15 lifted by a spring 14 to ignite the gas and provide a flame. The user just rotates the striker wheel 13 with his or her thumb and at the same time presses the plate 112 down to create and maintain the flame. This simplified lighter's price is commonly about 25 cents in Taiwan and 50 cents in the United States. Because of its advantages of being cheap and convenient, the product has prevailed worldwide despite its tendency to stick in a open condition and thereby present a danger of conflagration particularly if operated by children.

SUMMARY OF THE INVENTION

The invention provides a safety lighter which prevents unexpected conflagrations effectively by means which urges the operating lever out of engagement with the gas pipe when the lever is released ensuring that the gas pipe can drop and thereby close the gas valve.

The invention is developed for safety purposes and includes an elastic spring element fitted between the lighter body and the operating lever to urge the lever out of engagement with the gas pipe when it is released. When the lighter is operated, forward and downward pressure on the operating lever causes the groove in the front of the lever to engage and lift the gas pipe against the pressure of the spring element.

In one embodiment, the operating lever has mounting pins pivotally located in three-legged apertures formed in supports on the light body. The spring element urges the pins into the rearmost legs of the apertures to disengage the gas pipe. Downward and forward pressure on the lever when the lighter is operated moves the pins into the forward legs, causing the legs to engage the gas pipe.

In another embodiment, the operating lever has dependent lugs which move forward and back over uprights on the lighter body to engage and disengage the gas pipe.

BRIEF DESCRIPTION OF DRAWINGS

FIG. 7-1 is a perspective view of part of the mounting structure for an operating lever of the lighter shown in FIG. 7;

FIG. 7-2 is a perspective view from below the operating lever;

DETAILED DESCRIPTION OF THE INVENTION

Figure 2:
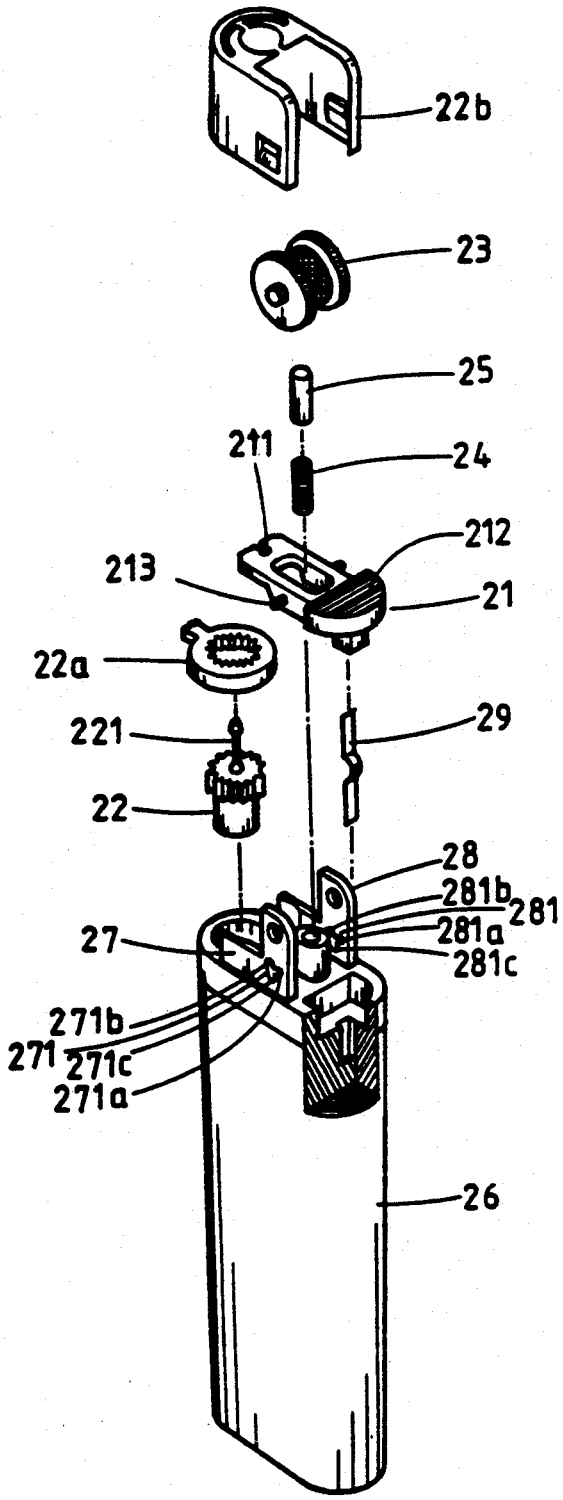
FIG. 2 is an exploded view of a first embodiment lighter according to the invention.
Figure 3:
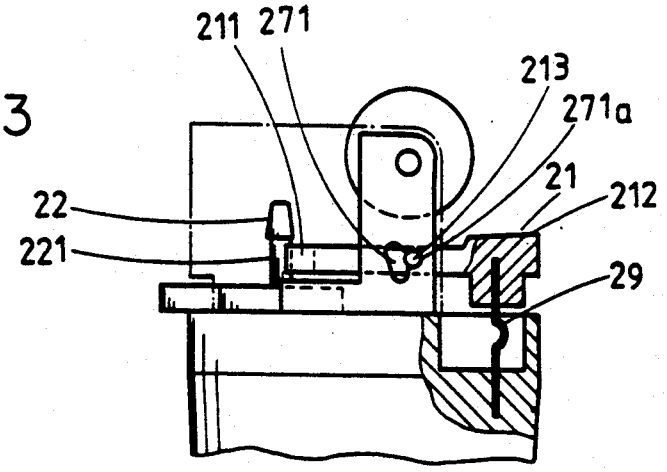
FIG. 3 is a side elevational view of the top of the lighter with its component parts in a released condition.
Figure 4:
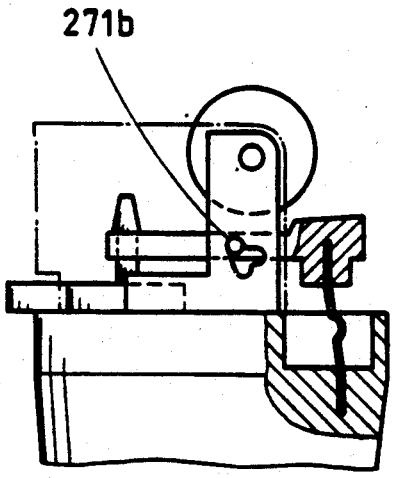
FIG. 4 is a view similar to FIG. 3 showing the lighter in a first phase of operation.
Figure 5:
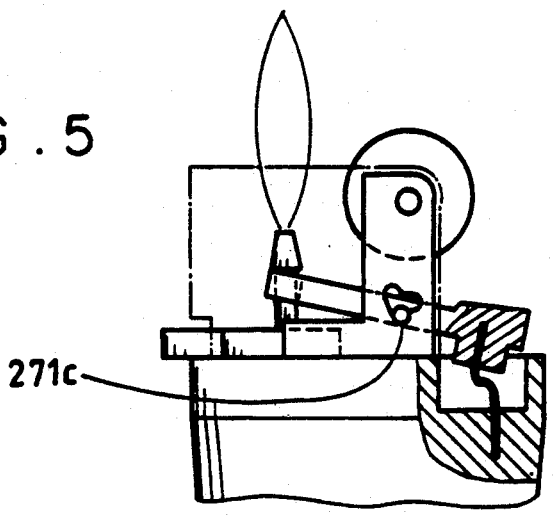
FIG. 5 is a view similar to FIGS.3 and 4 showing the lighter in a second phase of operation.

FIG. 2 is an exploded view of the first embodiment of lighter which has gas pipe 22, a flame regulator 22*a*, a cover 22*b*, a striker 23, a spring 24, a flint 25 and a lighter body 26 which are all substantially conventional. The primary differences are that elastic leaf spring element 29 is fitted between the operating lever 21 and the lighter body. Also, the supports 27, 28 which are located separately at opposite sides on top of the lighter are drilled with corresponding T-shaped apertures 271, 281. The apertures 271, 281 thus have respective legs 271*a*, 271*b*, 271*c* and 281*a*, 281*b*, 281*c*. The operating lever has pins 213 which fit in the respective apertures 271, 281. As shown in FIG. 3, in the released position of the operating lever 21, pressure of leaf spring 29 causes the two pins 213 of lever 21 to engage in the rear legs 271*a*, 281*a* of apertures 271, 281. The groove 211 in the forward part of lever 21 is disengaged from the neck part 221 of gas pipe 22. When operating the safety lighter as shown in FIG. 4, the thumb should first push the plate 212 of lever 21 to make the lever groove 211 engage with the gas pipe 22. With this motion, the two pins 213 of lever 21 are moved out from the rear legs 271*a*, 281*a* of apertures 271, 281 and into the upper legs 271*b*, 281*b*. Thus, the groove 211 at forward part of lever 21 will be engaged with the neck part 221 of gas pipe 22. As shown in FIG. 5, the thumb should then push downwards on the plate 212 while at the same time rotating striker wheel 23 to rub the flint 25 which is lifted by spring 24, so as to produce a spark. The two pins 213 of lever 21 will move to the bottom legs 271*c*, 281*c* from upper legs 271*b*, 281*b*. With this action, the groove 211 will lift the gas pipe 22 up and this operation will release gas from the valve which is located beneath the gas pipe for creating a flame by means of spark generated through mutual friction of striker wheel 23 and flint 25 and retain the flame while lever 21 is depressed.

Release spring 29 which is located under the bottom part of plate 212 will generate a rearward and upward rebound force on lever 21 when the lever is released. This causes the two pins 213 to move from the bottom legs 271*c*, 281*c* of apertures 271, 281 in an upward and rearward direction back into the rear legs 271*a*, 281*a*. The groove 211 will be disengaged and removed away from the neck part 211 of gas pipe 22.

The safety lighter thus features a mechanism for precisely snapping the groove 211 away from nect part 221 of gas pipe 22 and minimize sticking of the lighter in the flaming state when the lever is released. Also, the lighter needs a two stage manipulation to create a flame which makes it more difficult to be operated by children.

Figure 6:
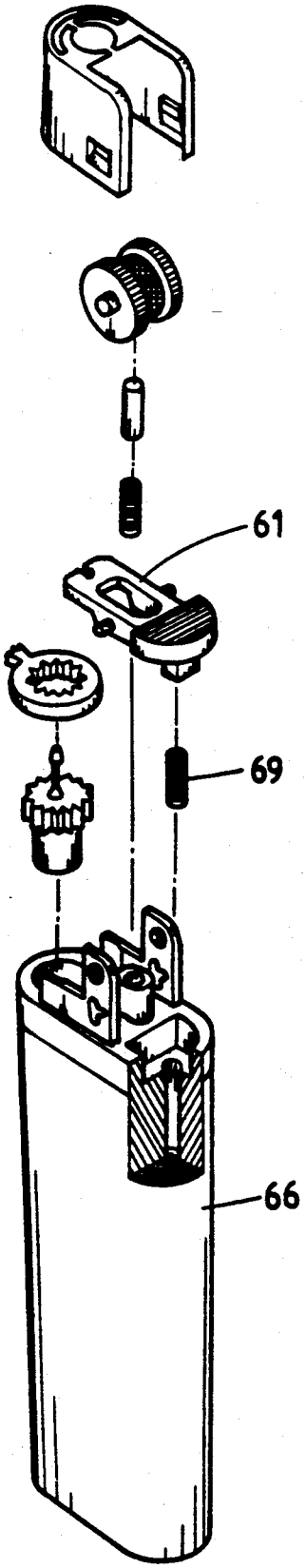
FIG. 6 is an exploded view of a second embodiment of the invention.

The safety lighter of the second embodiment shown in FIG. 6 is similar to the first embodiment with the exception that instead of lever 61 having a leaf spring, there is instead a coil spring 69.

Figure 1:
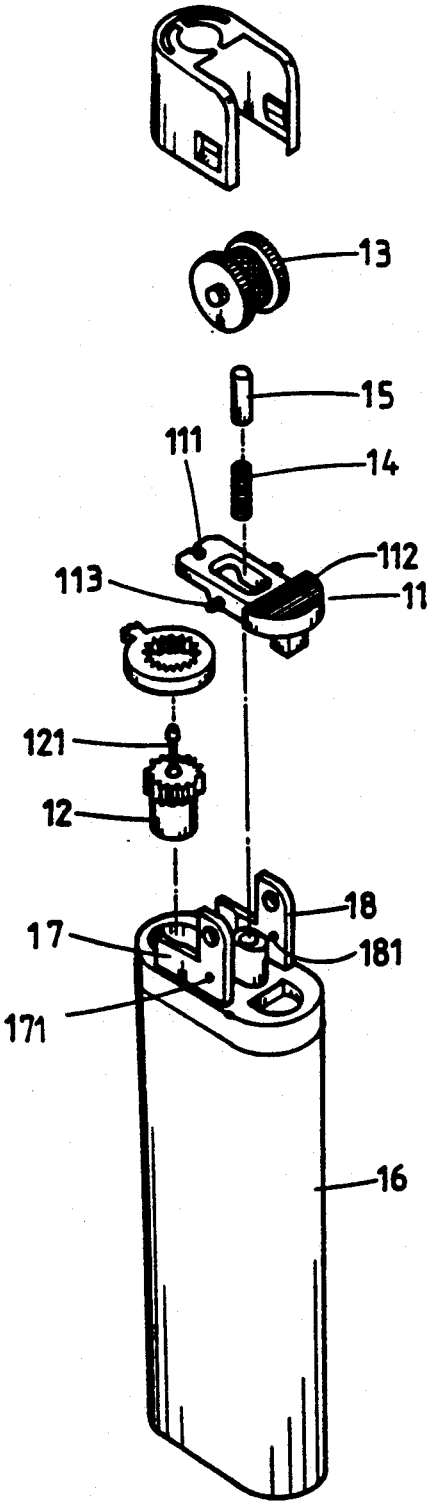
FIG. 1 (PRIOR ART)
FIG. 1. is an exploded view of a traditional gas fuel lighter.
Figure 7:
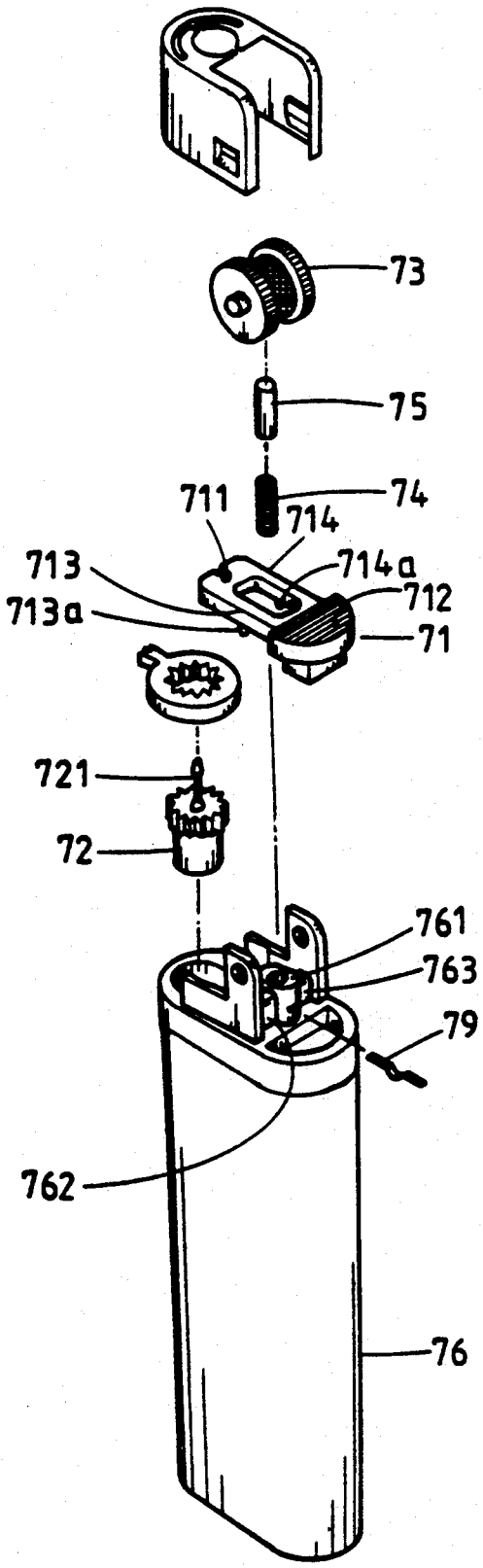
FIG. 7 is an exploded view of a third embodiment of the invention.
Figures 2, 7:
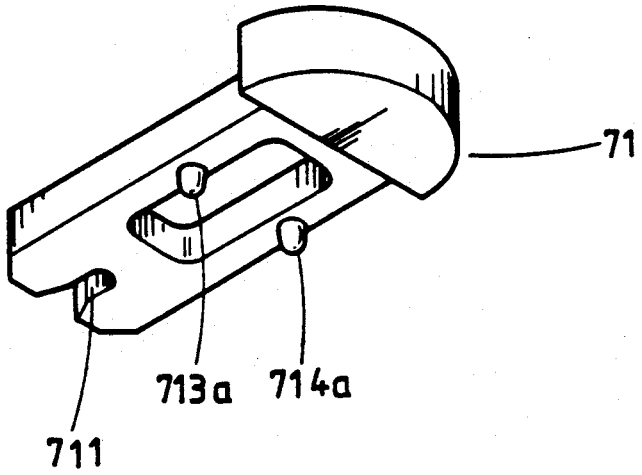
Figures 1, 7:
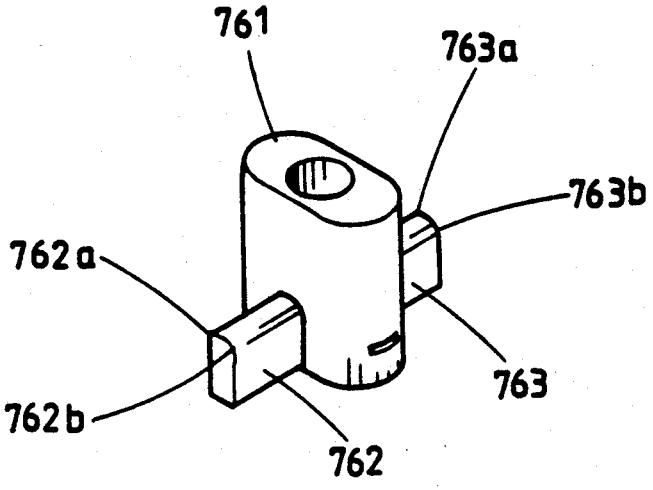

FIGS. 7 to 10 show a third embodiment of the invention wherein a horizontal leaf spring 79 is fitted between operating lever 71 and the back edge of the flint holder 761 at the top of the lighter body 76. In addition to this, uprights 762, 763 are provided on opposite sides of the flint holder. As shown in FIG. 7-1, the joins between the forward parts and upper parts of the uprights 762, 763 should form right angles 762*a*, 763*a*. The joins between the rear parts and upper parts of the uprights should form curves 762*b*, 763*b*. As shown in FIG. 7-2 protuberances 713*a*, 714*a* are provided on the bottom surfaces of the respective arms 713, 714 of lever 71.

Figure 8:
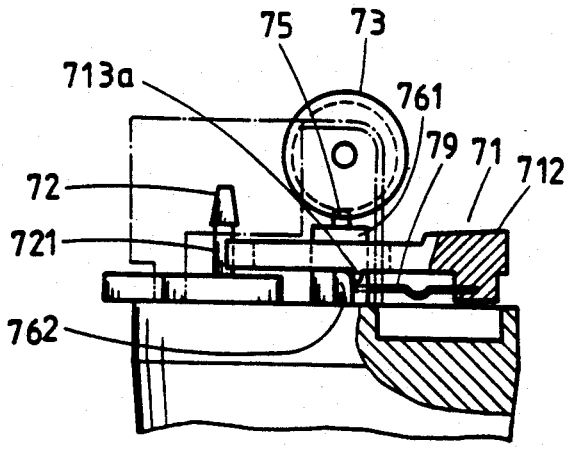
FIG. 8 is a side elevational view of the FIG. 7 embodiment in a released position.

As shown in FIG. 8, in the release position of the safety lighter, due to the resilience of leaf spring 79, the two protuberances 713*a*, 714*a* of lever 71 rests against the outside edges of curves 762*b*, 763*b* of the uprights and the lever 71 is disengaged from gas pipe 72.

Figure 9:
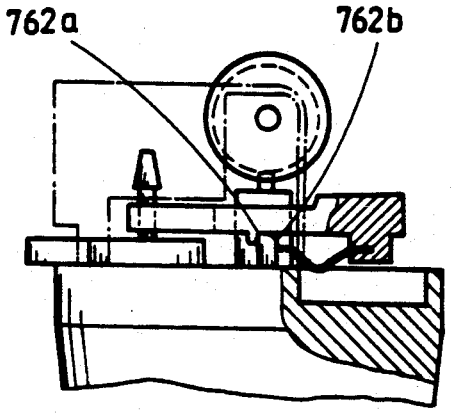
FIG. 9 is a view similar to FIG. 8 with the lighter in a first phase of operation.
Figure 10:
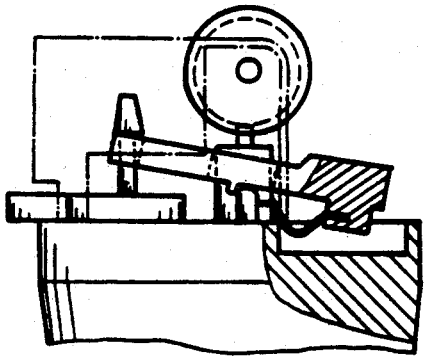
Fig. 10 if a view similar to FIGS. 8 and 9 with the lighter in a second phase of operation.

As shown in FIG. 9, a user should firstly use his thumb to push the lever 21 towrd the gas pipe 72. This operation will cause the two protuberances 713*a*, 714*a* to slide over the upper surfaces of the uprights and then snap against the outside edges of the right angles 762*a*, 763*a*. Consequently, the groove 711 at the forward end of the lever 71 will be engaged with the neck part 721 of gas pipe 72. When the user turns the striker wheel 73 to rub the flint 75 which is lifted by spring 74 for generating a spark, the thumb simultaneously pushed downward on the plate 712 of lever 71. As shown in FIG. 10, the two protuberances 713*a*, 714*a* remain against the outside right angles edges 762*a*, 763*a* of the uprights while the operating lever is pivoted. Thus, the groove 711 of lever 71 will lift the gas pipe 72 and the valve located beneath the gas pipe will be opened to produce a gas flow and flame when ignited by the generated spark. After application of the lighter, the thumb is withdrawn from the plate 712 and the lever 71 will be moved backward by the resilience of leaf spring 79. This operation will cause the two protuberances 713*a*, 714*a* to slide back over the upper surfaces of the uprights and return into engagement with the curve edges 762*b*, 763*b*. Meanwhile, the groove 711 will be removed from the neck part 721 of gas pipe 72.

What is claimed is:

1. In a gas lighter comprising a lighter body, a gas pipe mounted on the body for up and down movement to open and close a gas valve in the lighter body, mounting means on the body for an operating lever, an operating lever pivotally mounted on the mounting means, the lever having a pressure plate at one end and a groove at the opposite end for engaging a neck portion of the gas pipe and lifting the gas pipe to open the gas valve when the pressure plate is depressed, and a striker wheel and flint for creating a spark to ignite gas issuing from the gas pipe when the striker wheel is rotated and the pressure plate is depressed, the improvement wherein the operating lever is mounted on the mounting means for movement between first and second positions wherein said groove is respectively out of engagement with and in engagement with said neck portion of the gas pipe, and the lighter includes resilient means urging the lever to said first position whereby to operate the lighter, the lever must be moved to the second position causing the groove to engage the gas pipe and the pressure plate must be depressed to raise the gas pipe, and whereby when the lever is released the resilient means returns the lever to the first position disengaging the groove from the neck portion of the gas pipe.

2. The improvement defined in claim 1, wherein the mounting means comprises respective supports on opposite sides of the operating lever, an aperture in each support having a forward portion and a back portion, and a pin on each side of the lever fitting in a respective one of said apertures, the pins in the first position of the lever being located in the back portions of the respective apertures and being moved to the forward portions of the respective apertures when the lever is moved to the second position.

3. The improvement defined in claim 2, wherein the forward portion of each aperture has an upper leg and a lower leg, wherein the respective pin moves from the back portion of the aperture into the upper leg when the lever is moved from the first position to the second position, and from the upper leg into the lower leg when the pressure plate is depressed to lift the gas pipe.

4. The improvement defined in claim 2, wherein the resilient means comprises a spring connected between an undersurface of the pressure plate and the lighter body.

5. The improvement defined in claim 4 wherein the spring is a leaf spring.

6. The improvement defined in claim 4, wherein the spring is a coil spring.

7. The improvement defined in claim 1, wherein the lighter body includes an upwardly projecting flint holder, the operating lever has legs bounding a central opening in the lever and straddling the flint holder, the mounting means includes uprights on the lighter body on opposite sides of the flint holder and protuberances on undersurfaces of the respective legs of the lever for movement over said uprights, further wherein the resilient means comprises a spring connected between the flint holder and a part of the lever under said pressure plate and wherein in the first position of the lever said protuberances engage against rearward surfaces of said uprights and in the second position of the lever said protuberances move over the uprights and engage against forward surfaces of the uprights compressing the spring.

8. The improvement defined in claim 7 wherein said rearward surfaces of the uprights are curved and said forward surfaces of the uprights are sharp-edged.

* * * * *